US005971209A

United States Patent [19]

Bayless

[11] Patent Number: 5,971,209

[45] Date of Patent: Oct. 26, 1999

[54] OPERATING APPARATUS FOR AIR PUMP TYPE BEVERAGE DISPENSERS

[76] Inventor: Lee Bayless, 27526 Wellsley Way, Valencia, Calif. 91354-1603

[21] Appl. No.: 08/905,138

[22] Filed: Aug. 1, 1997

[51] Int. Cl.[6] ..... B67D 5/52

[52] U.S. Cl. ..... 222/135; 222/173; 222/401

[58] Field of Search ..... 222/129, 135, 222/173, 401, 402

[56] References Cited

U.S. PATENT DOCUMENTS

| | | | |
|---|---|---|---|
| 2,499,061 | 2/1950 | Gray | 222/173 |
| 4,119,244 | 10/1978 | Funke | 222/401 |
| 4,359,174 | 11/1982 | Ikunosuke et al. | 222/401 |
| 4,667,856 | 5/1987 | Nelson | 222/173 |
| 5,005,736 | 4/1991 | Portas | 222/173 |
| 5,156,297 | 10/1992 | Engler | 222/173 |
| 5,197,866 | 3/1993 | Kim | 222/401 |
| 5,238,146 | 8/1993 | Thorne, Jr. | 222/173 |

*Primary Examiner*—Joseph A. Kaufman
*Attorney, Agent, or Firm*—James E. Brunton

[57] ABSTRACT

An operating apparatus for safely and effortlessly operating beverage dispensers of the character which embody a manually operated air pump for expelling the beverage from the dispenser. The operating apparatus of the invention, which can simultaneously support and operate a plurality of air pump dispensers in a side-by-side relationship, safely constrains the dispensers within an upright supporting structure of novel design to which a number of lever-like, air-pump operating arms can be pivotally connected. The operating arms, each of which includes a pump engaging member, is separately movable from a first at rest position to a second, downward operating position. Because of the mechanical advantage offered by the lever-like operating arms of the device, the plunger component of the air pump can be effortlessly depressed while the dispenser is being securely held in position within the superstructure of the device.

16 Claims, 5 Drawing Sheets

OPERATING APPARATUS FOR AIR PUMP TYPE BEVERAGE DISPENSERS

BACKGROUND OF THE INVENTION

1. Field of the Invention

The present invention relates generally to devices for dispensing beverages. More particularly, the invention concerns a manually operated apparatus for operating the air pump of beverage dispensers of the character having an internally disposed air pump that includes a depressible plunger which, upon being depressed, causes the beverage to be dispensed from the container.

2. Discussion of the Prior Art

In recent years, beverage dispensers having internally mounted air pumps for dispensing the beverage from the dispenser have become very popular. In operating these types of dispensers, a plunger, which is usually mounted to the top of the dispenser, is depressed by the user to pressurize the interior of the dispenser container in a manner to controllably force the beverage from the container through a side mounted dispensing spout.

Dispensers of the aforementioned character are widely used in fast-food restaurants, including donut shops and the like for dispensing hot coffee and other beverages. In many instances several dispensers are located side by side in the serving area of the restaurant. The dispensers may be operated either by the customer or by employees of the restaurant.

In those establishments where the beverage is dispensed from the air pump dispensers by the employees, the repetitive pumping action required by the employee can become quite tiring by days end. Additionally, when hot beverages, such as coffee and tea are being dispensed, serious burn injuries can occur if the dispenser is accidentally tipped during the pumping action or if the arms or hands of the user accidentally come too close to the outlet of the dispenser during the dispensing operation. Additionally, because the pumping operation itself is cumbersome and somewhat awkward, the employees hands and arms can be unduly stressed sometimes causing numbness and other physical problems.

In the service establishments where the customer dispenses the beverage from the air pump dispensers, there is a danger that the customer can be seriously injured if the dispenser is not properly constrained or if the dispenser is operated in an improper and unsafe manner. Where several air pump dispensers are placed side by side in a restricted serving area, the risk of injury during the dispensing, particularly of hot beverages, increases because of the crowded serving conditions and because of the awkward manner in which the air pump of the typical dispenser must be operated.

The thrust of the present invention is directed toward solving the problems discussed in the preceding paragraphs by providing a novel, easy-to-use operating apparatus for safely operating the air pumps of the beverage dispenser while the dispensers are constrained in a secure position within the serving area. More particularly, the operating apparatus of the invention, which can simultaneously support and operate a plurality of air pump dispensers, safely constrains the dispensers within an upright supporting structure of novel design to which a number of lever-like, air-pump operating arms can be pivotally connected. The operating arms, each of which includes a pump engaging member, is separately movable from a first at rest position to a second, downward operating position. Because of the mechanical advantage offered by the lever-like operating arms of the device, the plunger component of the air pump can be effortlessly depressed while the dispenser is being securely held in position within the superstructure the device.

SUMMARY OF THE INVENTION

It is an object of the present invention to provide an operating apparatus for safely and effortlessly operating beverage dispensers of the character which embody a manually operated air pump for expelling the beverage from the dispenser.

Another object of the invention is to provide an operating apparatus of the aforementioned character which can be used to support and separately operate a plurality of beverage dispensers positioned in a side-by-side relationship.

Another object of the invention is to provide an apparatus as described in the preceding paragraphs which will accommodate beverage dispensers of different sizes and one which will safely secure the dispensers in a fixed position during the beverage dispensing operation.

Another object of the invention is to provide an operating apparatus for operating air pump type beverage dispensers which is easy to use, is of simple construction and requires little or no maintenance.

DESCRIPTION OF THE INVENTION

Figure 1:
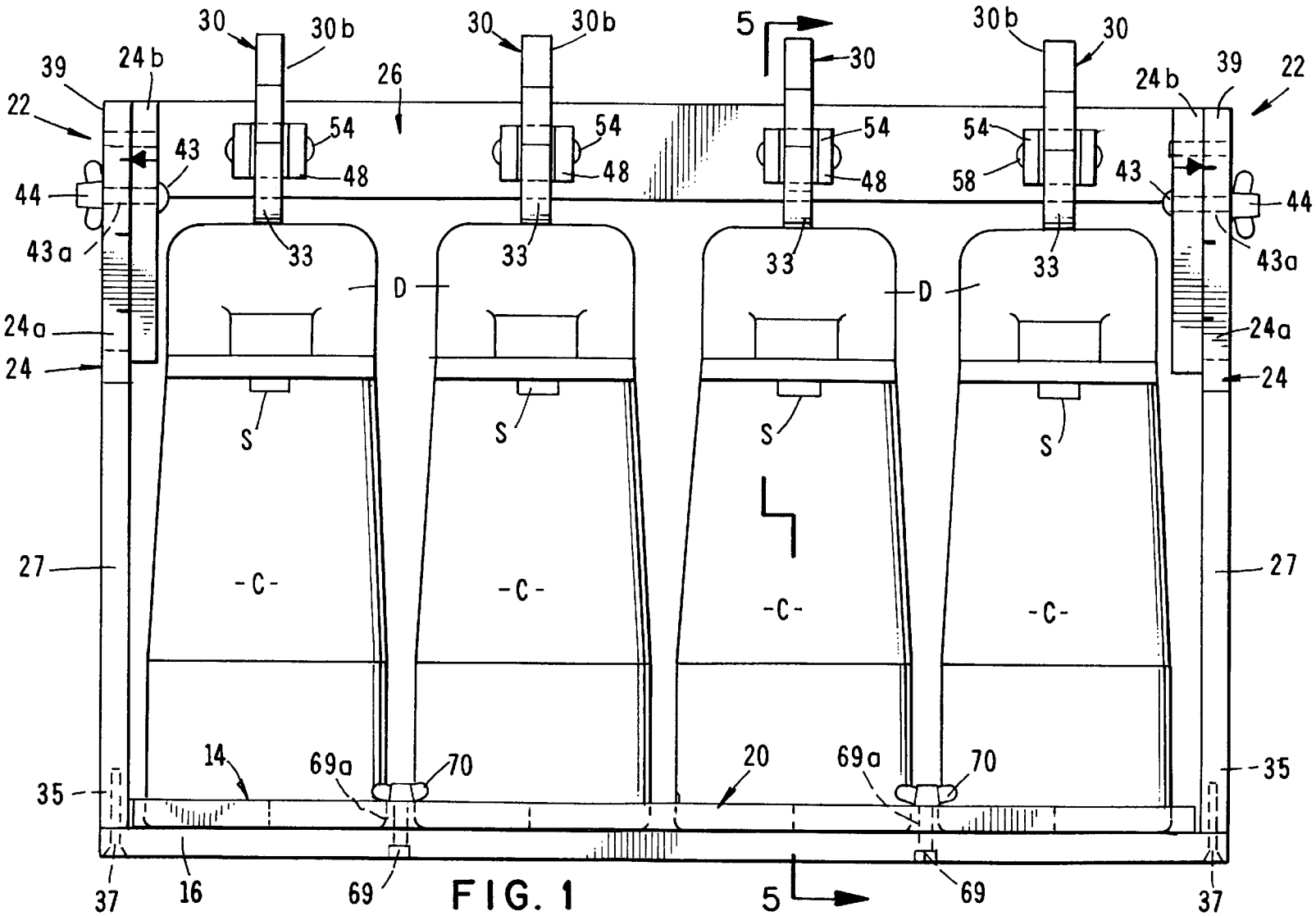
FIG. 1 is a front elevational view of one form of the operating apparatus of the invention for operating a plurality of beverage containers.
Figure 2:
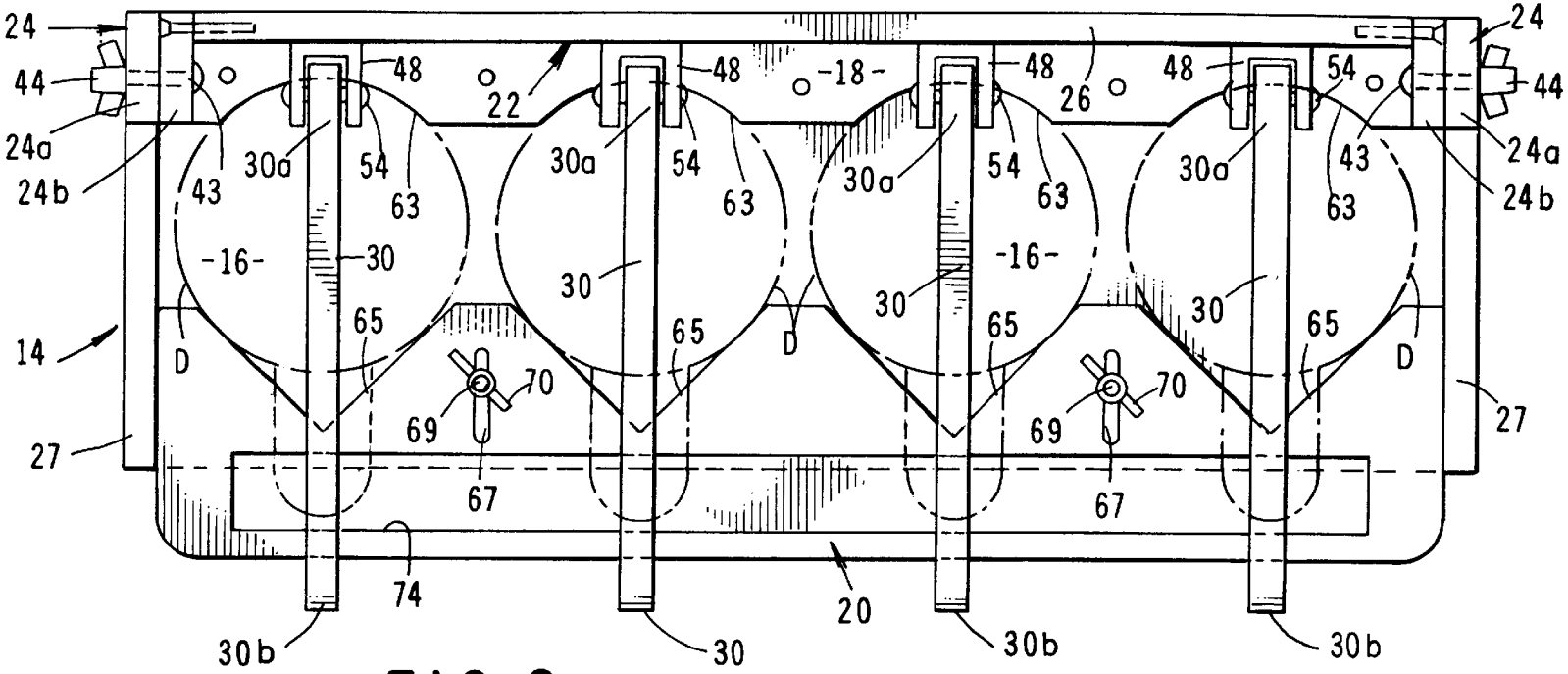
FIG. 2 is a top plan view of the apparatus shown in FIG. 1.

Referring to the drawings and particularly to FIGS. 1 through 5, one form of the operating apparatus of the present invention is there illustrated. This form of the operating apparatus is adapted to accommodate a plurality of beverage dispensers "D" each being of the character comprising a container portion "C" having an internally disposed air pump (not shown) which is operated by a depressible plunger "P" (FIG. 9) to cause the beverage contained within the container to be dispensed therefrom through a delivery spout "S". Beverage dispensers "D" are of a character well known in the art and are readily commercially available from a number of sources such as the United States company Cooks Club, Inc. of Harrison, N.J. and the Japanese Peacock Company. While the commercial dispensers are obtainable in various sizes, they all embody substantially identical operating components.

In the form of the invention shown in the drawings, the operating apparatus comprises a base assembly 14 comprising a floor defining member 16 and locating means connected to floor member 16 for locating the beverage dispensers "D" on the floor member in a side-by-side relationship as shown in FIG. 1. The locating means here comprises a first, rearwardly disposed dispenser engaging member 18 which is interconnected with floor member 16 and a second, forwardly disposed dispensing engaging member 20 which is slidably connected to floor member 16. The details of the construction and operation of this novel locating means will presently to be described. Connected to base assembly 14 in an upright shown in the drawings as upright framework 22. Upright framework 22 comprises spaced-apart side assemblies 24 and an elevated cross-member 26 which is connected to and spans side assemblies 24.

Figure 5:
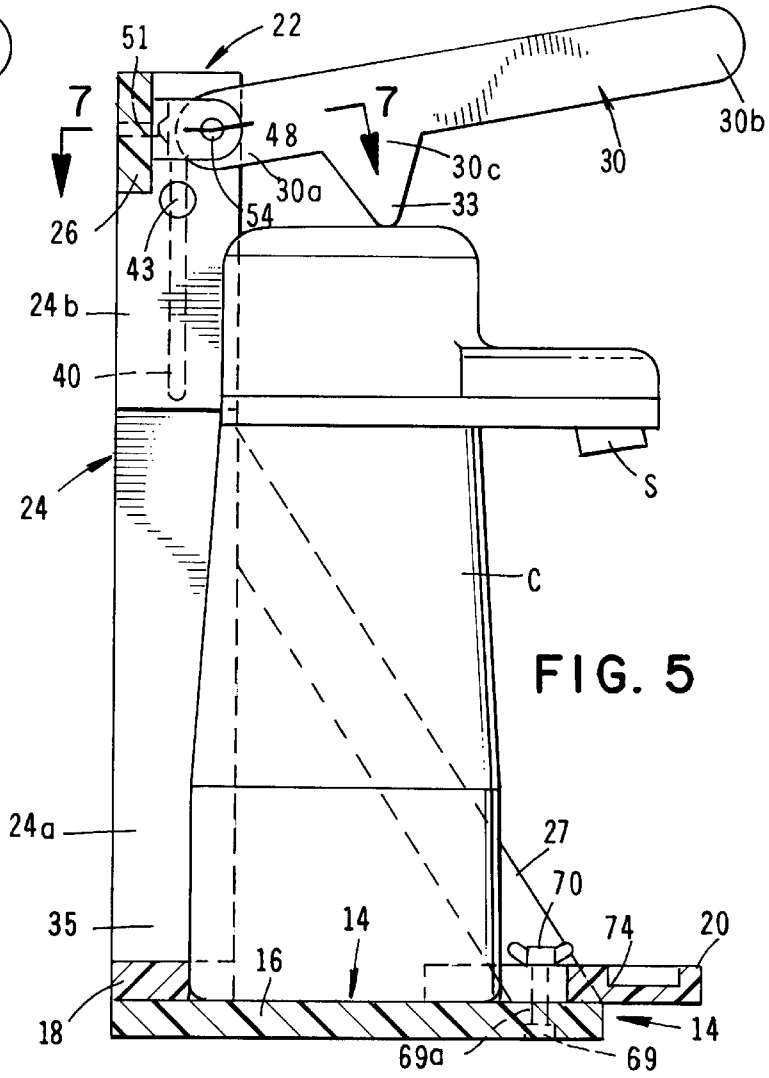
FIG. 5 is a cross-sectional view taken along lines 5—5 of FIG. 1.

Forming an extremely important aspect of the operating apparatus of the present invention is operating means for operating the air pumps of the beverage dispensers "D". This novel operating means here comprise a plurality of lever-like operating arms 30 which are pivotally connected to cross member 26 for movement between the first elevated position shown in FIG. 4 to the second operating or beverage dispensing position shown in FIG. 9. As best seen in FIG. 5, each operating arm 30 extends outwardly from cross member 26 and each includes a first end portion 30*a* which is pivotally connected to cross member 26 and a second end portion 30*b* which forms the handle portion of the operating arm which is grippable by the user of the apparatus. Formed intermediate ends 30*a* and 30*b* of arms 30 is an intermediate portion 30*c* which is disposed over the beverage dispensers resting on base assembly 14. This intermediate portion 30*c* comprises the plunger engaging means of the invention and comprises a generally V-shaped protuberance 33 which functions to depress the depressible plunger "P" of the air pump upon the operating arm being moved toward the second position shown in FIG. 9.

Figure 6:
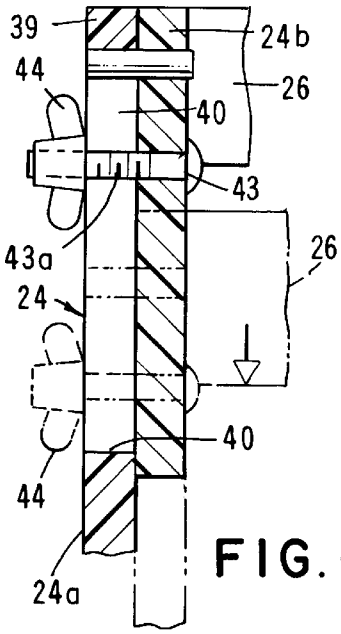
FIG. 6 is an enlarged, cross-sectional view taken along lines 6—6 of FIG. 4.

As best seen by referring to FIGS. 1 and 6, side assemblies 24 each comprise a first side member 24*a* and a cooperating second side member 24*b*. Each side member 24*a* has a lower extremity 35 which is interconnected with floor member 16 by suitable connectors such as screws 37 (FIG. 1). The upper portion 39 of each side member 24*a* is provided with an elongated, generally vertically extending slot 40. Each side member 24*b* is provided with a threaded connector 43 which includes a shank portion 43*a* that extends through and is slidably received within slot 40. A wing nut 44 is threadably received on each connector 43 and functions when tightened against a side member 24*a* to position the side member 24*b* at a selected height above the base assembly 14.

Figure 4:
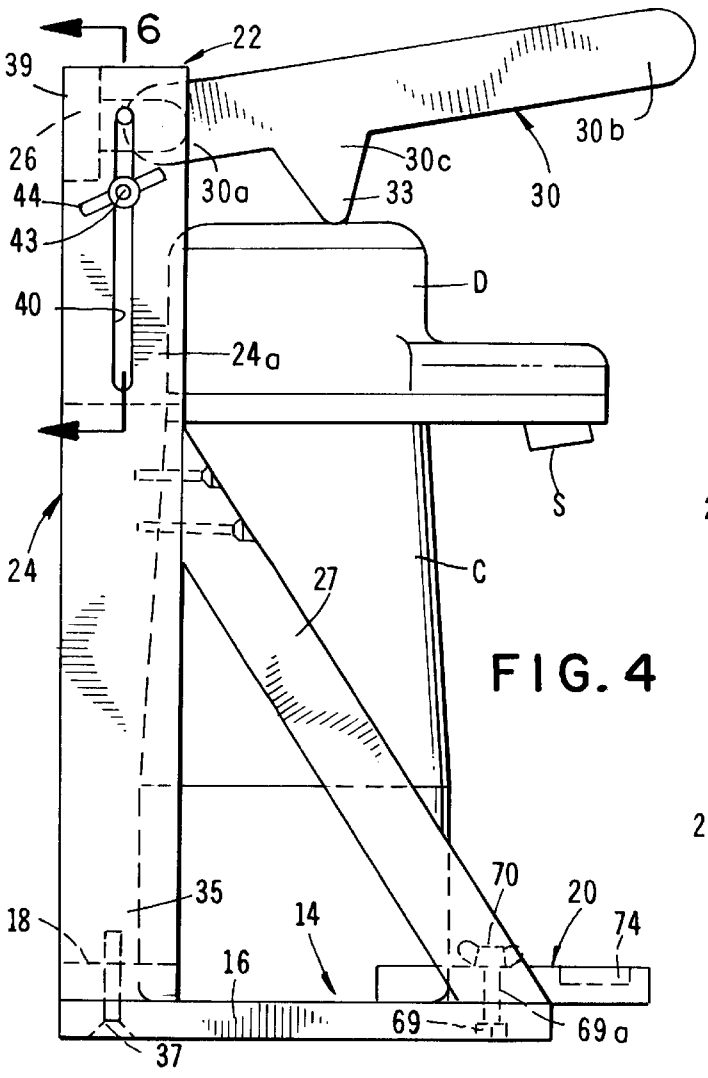
FIG. 4 is a side-elevational view of the apparatus shown in FIGS. 1 and 2.
Figure 11:
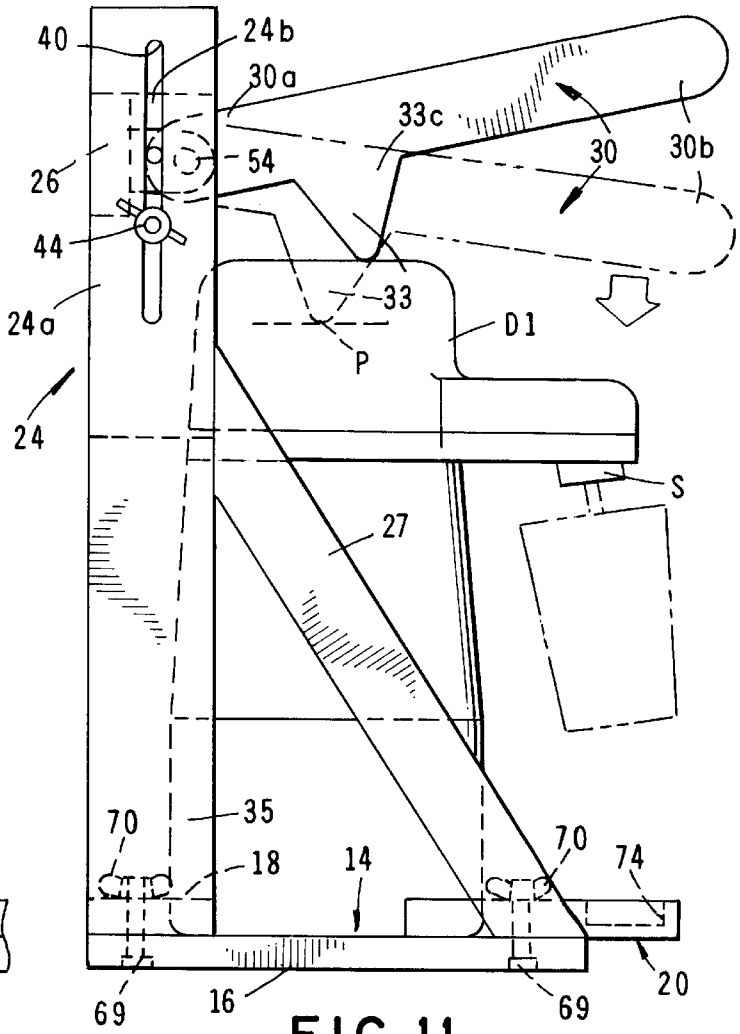
FIG. 11 is a side-elevational view of the apparatus shown in FIG. 10 having phantom lines illustrating the movement of the lever-like operating arm into the fluid dispensing position.
Figure 10:
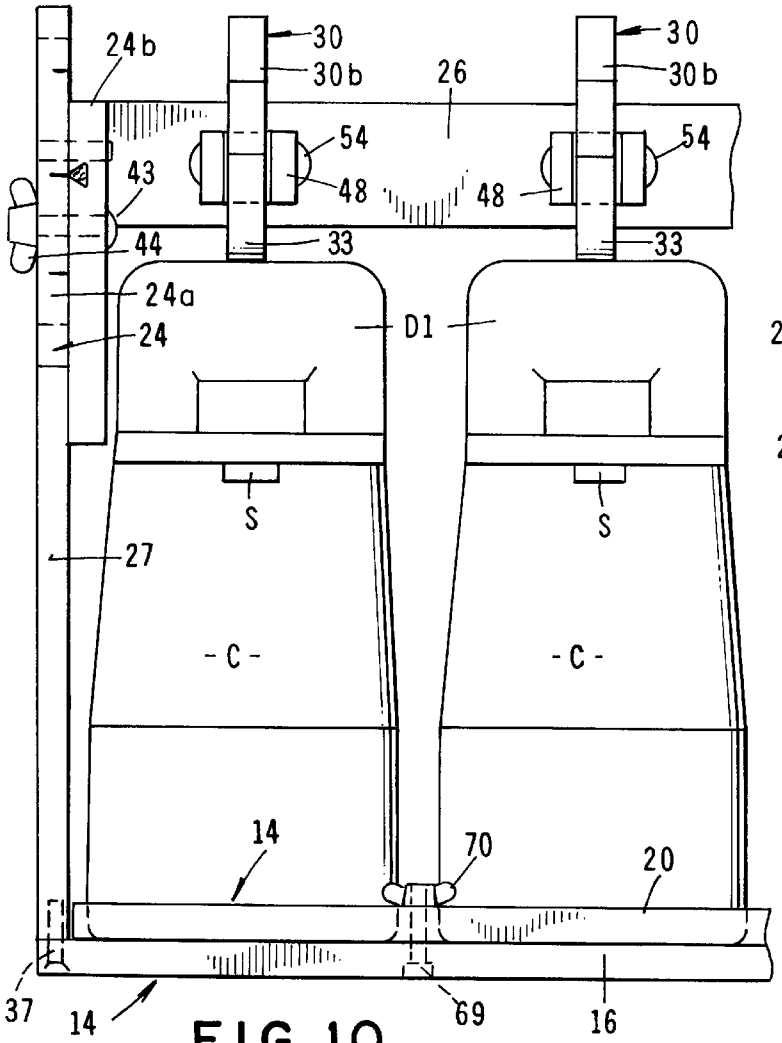
FIG. 10 is a fragmentary, front elevational view similar to FIG. 1, but showing the apparatus having been adjusted to accommodate beverage dispensers of a different size.

Turning to FIGS. 10 and 11, it is to be noted that with the construction described in the preceding paragraph, side member 24*b* along with cross member 26 to which it is connected can be adjusted relative to side member 24*a* so as to controllably adjust the height of cross member 26 and, in turn, the operating arms 30 relative to the upper surface of floor member 16. Accordingly, when the apparatus of the invention is used with smaller dispensers, such as dispensers "D-1" which are of the character shown in FIGS. 10 and 11, the wing nuts 44 of each side assembly 24 can be loosened and side member 24*b* can be lowered to enable the so operating arms 30 to moved into the correct operating position with respect to dispensers "D-1". With the operating arms thusly positioned, they can be selectively operated to depress the plunger "P" of the dispenser "D-1" over which the arm is superimposed in the manner indicated by the phantom lines of FIG. 11. To provide rigidity to side members 24*a*, diagonal braces 27 extend between floor member 16 and each side member (FIG. 4).

Figure 7:
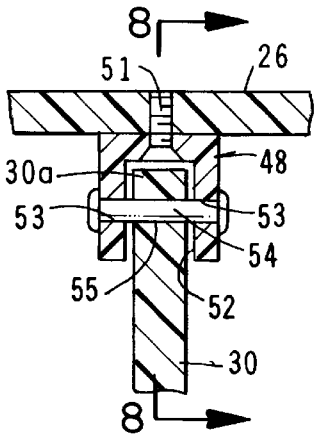
FIG. 7 is an enlarged, cross-sectional view taken along lines 7—7 of FIG. 5.
Figure 8:
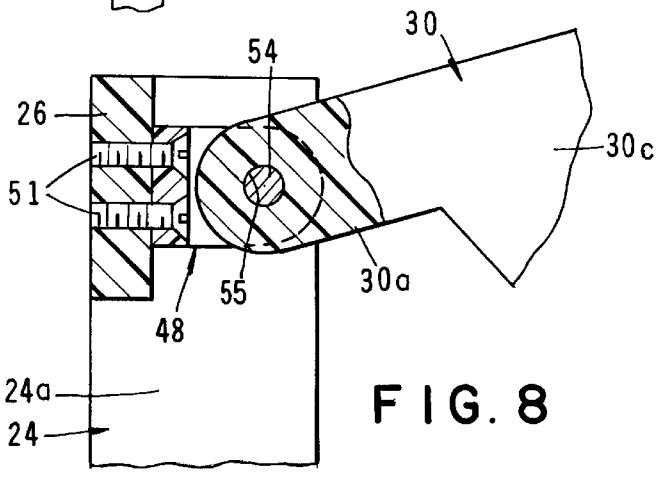
FIG. 8 is a cross-sectional view taken along lines 8—8 of FIG. 7.

Turning now to FIGS. 7 and 8, it is to be observed that each of the operating arms 30 is pivotally interconnected with cross member 26 by means of brackets 48 which are, in turn, interconnected with cross member 26 by threaded connectors such as connectors 51. Each of the brackets 48 includes a channel-like opening 52 which closely receives the end portion 30*a* of an operating arm 30. The side portions of bracket 48, which define the channel-like opening, as well as end portion 30*a* of operating arm 30, are drilled to accept a pivot pin 54. As best seen in FIG. 7, pivot pin 54 extends through drilled bores 53 provided in the side portions of bracket 48 and also through a drilled bore 55 provided in end portion 30*a* of operating arm 30. With this construction, each arm 30 is readily pivotally movable between the first elevated position shown in FIG. 4 and the second beverage dispensing position shown in FIG. 9.

Figure 3:
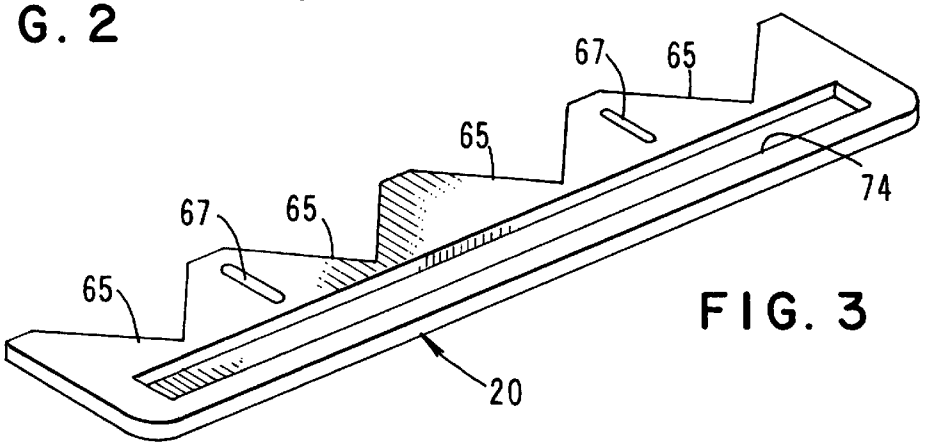
FIG. 3 is a generally perspective view of the forward beverage dispenser clamping member of the base assembly of the apparatus.

Turning once again to FIGS. 2 and 3, it is to be noted that first dispensing engaging member 18 of the locating means of the invention is affixed to floor member 16 by any suitable means such as adhesive bonding or threaded connectors. To closely receive the base portion of a dispenser "D", a plurality of arcuate shaped cut-outs 63 are provided at longitudinally spaced locations along the length of first dispenser engaging member 18 (FIG. 1). The second dispenser engaging means, the configuration of which is best seen in FIG. 3, rather than being fixedly connected to floor member 16 is slidably connected thereto so that the second dispenser engaging member can be moved toward and away from first dispenser engaging member 18 to accommodate dispensers of various sizes. More particularly, second dispenser engaging member 20 is provided with a plurality of longitudinally spaced, generally V-shaped cut-outs 65 the sides of which are movable into engagement with the base portions of the dispensers "D" as member 20 is moved in a sliding relationship with floor member 16 in a direction toward first dispenser engaging member 18. To permit this sliding movement, dispensing engaging member 20 is provided with a pair of longitudinally spaced slots 67 which closely receive the shank portions 69a of a pair of spaced-apart threaded connectors 69 which are connected to and extend upwardly from the top surface of floor member 16 (FIG. 1). Wing nuts 70 are provided on threaded connectors 69 so that dispenser engaging member 20 can be securely clamped at a selected location against floor member 16. By loosening wing nuts 70, member 20 can be moved either toward or away from dispenser engaging member 18 to accommodate dispensers having different size base portions.

Referring to FIGS. 10 and 11, it is to be noted that in the form of the invention there shown, the first dispenser engaging member 18*a* is also slidable with respect to floor member 16. For this purpose member 18*a* is slotted to receive shank portion of connectors such as connector 69 (FIG. 11) and functions in the same manner as sliding member 20.

Figure 9:
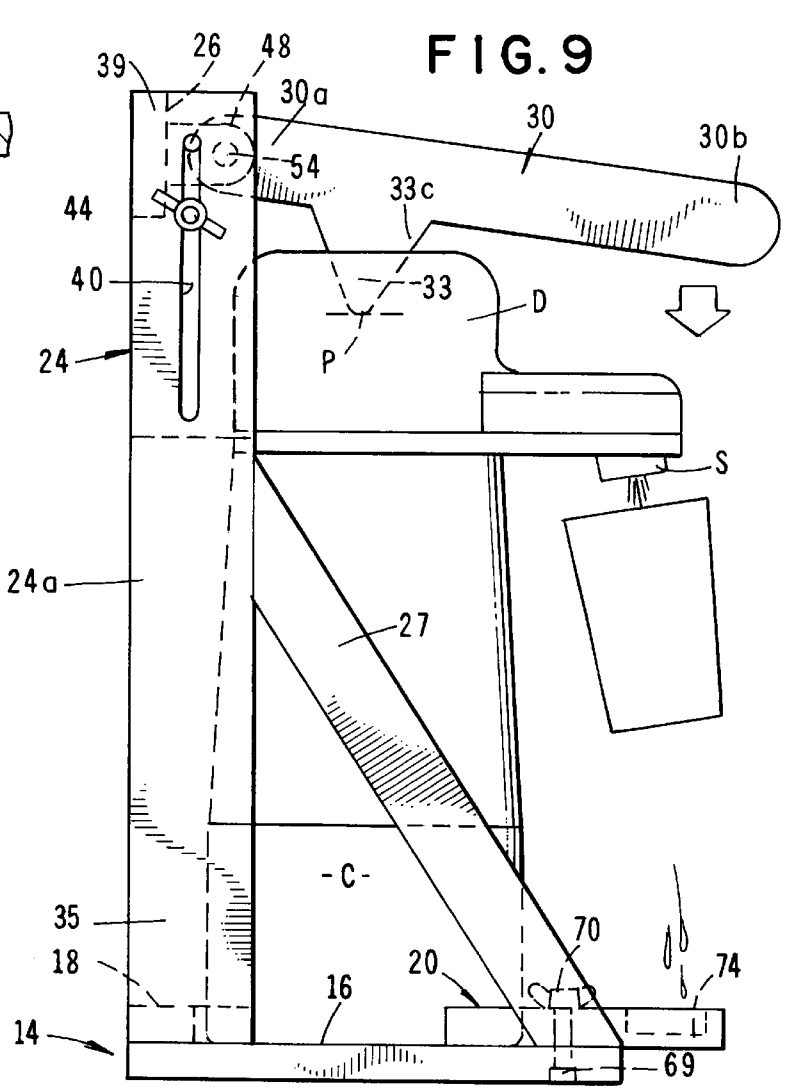
FIG. 9 is a side-elevational view similar to FIG. 4, but showing one of the lever-like operating arms of the apparatus moved into a fluid dispensing position.

As best seen by referring to FIG. 3, second dispenser engaging member 20 is also uniquely provided with an elongated fluid capture channel 74 which, as illustrated in FIG. 9 is adapted to contain fluid spills which may occur during the beverage dispensing operation (see FIG. 9). This capture channel functions to effectively capture and retain spilled liquids and thereby help to prevent the spill of liquids onto the floor and onto table tops located within the serving area.

It is to be understood that the frame work of the apparatus of the invention can be constructed from plastic, wood, metal or any other suitable material.

Having now described the invention in detail in accordance with the requirements of the patent statutes, those skilled in this art will have no difficulty in making changes and modifications to the individual parts or their relative assembly in order to meet specific requirements or conditions. Such changes and modifications may be made without departing from the scope and spirit of the invention, as set forth in the following claims.

I claim:

1. An operating apparatus for operating a beverage dispenser of the character comprising a container having an internally disposed air pump which is operated by a depressible plunger to cause the beverage contained within the container to be dispensed therefrom, said operating apparatus comprising:

(a) a base, including a floor member and locating means connected to said floor member for locating the beverage dispenser on said base, said locating means comprising:

(i) a first dispenser engaging member connected to said floor member; and (ii) a second dispenser engaging member slidably connected to said floor member for movement toward and away from said first dispenser engaging member;

(b) an upright connected to said base; and (c) operating means connected to said upright for operating the air pump, said operating means comprising an operating arm pivotally connected to said upright for movement between a first position and a second position, said operating arm including plunger engaging means for depressing the plunger of the air pump upon said operating arm being moved to said second position.

2. An apparatus as defined in claim 1 in which both said first and second dispenser engaging members have cutouts for receiving the beverage container.

3. An apparatus as defined in claim 1 in which said second dispenser member is provided with an elongated fluid capture channel.

4. An operating apparatus for operating a beverage dispenser of the character comprising a container having an internally disposed air pump which is operated by a depressible plunger to cause the beverage contained within the container to be dispensed therefrom, said operating apparatus comprising:

(a) a base;

(b) an upright connected to said base comprising:

(i) spaced apart sides; and (ii) an elevated cross member connected to and spanning said spaced apart sides; and (c) an operating arm pivotally connected to said elevated cross-member for movement between first and second positions, said operating arm extending outwardly from said cross member and including:

(i) a first end portion pivotally connected to said elevated cross member; and (ii) an intermediate portion superimposed over the beverage dispenser, said intermediate portion including plunger engaging means for operably engaging the depressible plunger of the beverage dispenser in a manner to depress the plunger upon said operating arm being moved toward said second position.

5. An apparatus as defined in claim 4 in which said second end portion of said operating arm comprises a handle and in which said plunger engaging means comprising a protuberance formed on said intermediate portion of said operating arm.

6. An apparatus as defined in claim 4 in which each of said sides comprises:

(a) a first side member; and (b) a second side member adjustably connected to said first side member, said cross member being connected to said second side member, whereby the height of said cross member above said base can be adjusted.

7. An apparatus as defined in claim 4 in which said locating means comprises:

(a) a first dispenser engaging member slidably connected to said floor member; and (b) a second dispenser engaging member slidably connected to said floor member for movement toward and away from said first dispenser engaging member.

8. An apparatus as defined in claim 7 in which both said first and second dispenser engaging members have cutouts for receiving the beverage container.

9. An apparatus as defined in claim 7 in which said cut-out in said first dispenser engaging member is generally semicircular in shape and in which said cut-out in said second dispenser engaging member is generally angular in shape.

10. An apparatus as defined in claim 7 in which said second dispenser member is provided with an elongated fluid capture channel.

11. An operating apparatus for operating a plurality of beverage dispensers each being of the character comprising a container having an internally disposed air pump which is operated by a depressible plunger to cause the beverage contained within the container to be dispensed therefrom, said operating apparatus comprising:

(a) a base assembly including:

(i) a floor member; and (ii) locating means connected to said floor for locating the beverage dispensers on said floor in a side-by-side relationship;

(b) an upright frame work connected to said base comprising;

(i) spaced apart sides; and (ii) an elevated cross member connected to and spanning said spaced apart sides; and (c) operating means for operating the air pumps of the beverage dispensers comprising a plurality of operating arms pivotally connected to said elevated cross member for movement between first and second positions, each said operating arm extending outwardly from said cross member and including:

(i) a first end portion pivotally connected to said elevated cross member;

(ii) an intermediate portion superimposed over the beverage dispenser, said intermediate portion including plunger engaging means for operably engaging the depressible plunger of the beverage dispenser in a manner to depress the plunger upon said operating arm being moved toward said second position; and (iii) a second end portion comprising a handle grippable by the user of the apparatus.

12. An apparatus as defined in claim 11 in which said plunger engaging means comprises a generally "V" shaped protuberance formed on said intermediate portion of said operating arm.

13. An apparatus as defined in claim 11 in which each of said sides comprises:

(a) a first side member; and (b) a second side member adjustably connected to said first side member, said cross member being connected to said second side member, whereby the height of said cross member above said base can be adjusted.

14. An apparatus as defined in claim 13 in which said locating means comprises:

(a) a first dispenser engaging member affixed to said floor member; and (b) a second dispenser engaging member slidably connected to said floor member for movement toward and away from said first dispenser engaging member.

15. An apparatus as defined in claim 14 in which both said first and second dispenser engaging members have cut-outs for receiving the beverage container.

16. An apparatus as defined in claim 15 in which said dispenser engaging member includes an elongated fluid capture channel.

* * * * *